US007397576B2

(12) United States Patent
Hong et al.

(10) Patent No.: US 7,397,576 B2
(45) Date of Patent: Jul. 8, 2008

(54) APPARATUS FOR AND METHOD OF RECOGNIZING TRAYS IN A PRINTER

(75) Inventors: Choon-ho Hong, Gyeonggi-do (KR); Chun-gu Han, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1135 days.

(21) Appl. No.: 10/178,955

(22) Filed: Jun. 25, 2002

(65) Prior Publication Data

US 2003/0048474 A1 Mar. 13, 2003

(30) Foreign Application Priority Data

Aug. 29, 2001 (KR) ..... 2001-52563

(51) Int. Cl.
*G03G 15/00* (2006.01)

(52) U.S. Cl. ..... 358/1.15; 399/12; 399/391; 399/393

(58) Field of Classification Search ..... 700/13, 700/266; 358/1.15; 399/393, 12, 391
See application file for complete search history.

(56) References Cited

U.S. PATENT DOCUMENTS 6,697,679 B2 * 2/2004 Hatakeyama ..... 700/13
7,103,289 B2 * 9/2006 Hong ..... 399/12

* cited by examiner

*Primary Examiner*—Edward Coles
*Assistant Examiner*—Chan S Park
(74) *Attorney, Agent, or Firm*—Staas & Halsey LLP

(57) ABSTRACT

An apparatus for and method of operating a printer recognizes and allocates a unique identification (ID) to each of a plurality of trays, which are mounted in a printer as options. The apparatus includes a signal transmission unit transmitting a recognition signal to trays from a main frame of a printer, and a recognition unit reading the recognition signal from the trays, recognizing unique codes which correspond to the trays, and transmitting the unique codes of the trays to the main frame of a printer. The unique IDs of trays, which are mounted as options, can be recognized without a manual operation by a user, thereby giving convenience to the user and preventing errors from occurring during an operation of the printer.

19 Claims, 4 Drawing Sheets

APPARATUS FOR AND METHOD OF RECOGNIZING TRAYS IN A PRINTER

CROSS-REFERENCE TO RELATED APPLICATIONS

This application claims the benefit of Korean Application No. 2001-52563, filed Aug. 29, 2001, in the Korean Industrial Property Office, the disclosure of which is incorporated herein by reference.

BACKGROUND OF THE INVENTION

1. Field of the Invention

The present invention relates to an apparatus for and method of recognizing trays in a printer, and more particularly, to an apparatus for and method of recognizing trays optionally mounted in a printer using a unique identification (ID) assigned to each tray.

2. Description of the Related Art

FIGS. 1A and 1B are block diagrams illustrating a conventional apparatus for recognizing trays in a printer. Referring to FIG. 1A, the conventional apparatus for recognizing trays includes a main frame "a" including a main controller a-1, a first option tray 1*a* including a first controller 1*a*-1 for the first option tray, a second option tray 2*a* including a second controller 2*a*-1 for the second option tray, and a third option tray 3*a* including a third controller 3*a*-1 for the third option tray. The main controller a-1 controls transmission and reception of printing data, data processing, motors, sensors, communications with the trays, and printing. The first controller 1*a*-1, the second controller 2*a*-1, and the third controller 3*a*-1 perform control operations to control motors and sensors required by the main controller a-1.

A serial interface 4*a* transmits control data required by the main controller (a-1) and necessary information. The first controller 1*a*-1, the second controller 2*a*-1, and the third controller 3*a*-1 have independent interface lines. In FIG. 1A, since data is transmitted and received between the main controller a-1 and the first controller 1*a*-1, the second controller 2*a*-1, and the third controller 3*a*-1 through the serial interface 4*a*, which is independently connected to each of the first, second, and third controllers 1*a*-1, 2*a*-1, and 3*a*-1, the main controller a-1 allocates a unique identification (ID) to each of the first, second, and third option trays 1*a*, 2*a*, and 3*a* and determines whether the first, second, and third option trays 1*a*, 2*a*, and 3*a* are connected or not. However, the apparatus in FIG. 1A has the following drawbacks. A production cost of the independent serial interface 4*a* is high, the structure of the serial interface 4*a* is complex, and the first, second, and third option trays 1*a*, 2*a*, and 3*a* each should be distinctive.

Referring to FIG. 1B, the conventional apparatus for recognizing trays includes a main frame "b" including a main controller (b-1), a first option tray 1*b* including a first controller 1*b*-1 and a first switch 1*b*-2, a second option tray 2*b* including a second controller 2*b*-1 and a second switch 2*b*-2, and a third option tray 3*b* including a third controller 3*b*-1 and a third switch 3*b*-2. The operation of each block is the same as that in FIG. 1A except the first, second, and third switches 1*b*-2, 2*b*-2, and 3*b*-2 manually set by the first, second, and third option trays 1*b*, 2*b*, and 3*b*. A serial interface 4*b* includes a data transmission line, such as a bus. Referring to FIG. 1B, the first, second, and third option trays 1*b*, 2*b*, and 3*b* recognize their own identifications (IDs) through the first, second, and third switches 1*b*-2, 2*b*-2, and 3*b*-2 and transmit IDs to the main controller b-1. Thus, the main controller b-1 recognizes the IDs of each of the first, second, and third option trays 1*b*, 2*b*, and 3*b* and determines whether or not the first, second, and third option trays 1*b*, 2*b*, and 3*b* are connected. However, a user should manually operate the first, second, and third switches 1*b*-2, 2*b*-2, and 3*b*-2. Further, if the user accidentally sets the same ID to different trays, errors occur during the operation of the printer in data transmission and reception, which may damage the trays in the printer.

SUMMARY OF THE INVENTION

To solve the above and other problems, it is an object of the present invention to provide an apparatus for recognizing trays in which a plurality of trays automatically recognize and transmit their own IDs without requiring any manual operation by a user in a case where the trays are optionally mounted in a printer.

It is another object of the present invention to provide a method of recognizing trays in which a plurality of trays automatically recognize and transmit their own IDs without requiring a manual operation by a user in a case where the trays are optionally mounted in a printer.

Additional objects and advantages of the invention will be set forth in part in the description which follows and, in part, will be obvious from the description, or may be learned by practice of the invention.

Accordingly, to achieve the above and other objects, according to an embodiment of the present invention, there is provided an apparatus for recognizing trays. The apparatus includes a signal transmission unit transmitting a recognition signal to trays from a main frame of a printer and a recognition unit controlling the trays to read the recognition signal, recognize unique codes which correspond to the trays in response to the recognition signal, and transmit the unique codes of the trays to the main frame of a printer.

In order to achieve the above and other objects, according to another embodiment of the present invention, there is provided an apparatus for recognizing trays. The apparatus includes including a signal transmission unit transmitting a recognition signal to trays from a main frame of a printer, and a recognition unit controlling the trays to read the recognition signal, which is modified according to the number of the trays, recognize unique codes of the trays in response to the recognition signal, and transmit the unique codes of the trays to the main frame of a printer.

In order to achieve the above and other objects, there is provided a method of transmitting a recognition signal to a plurality of trays from a main frame of a printer, controlling the trays to read the recognition signal and recognize unique codes which correspond to the trays in response to the recognition signal, and transmitting the unique codes of the trays to the main frame of the printer.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1A:
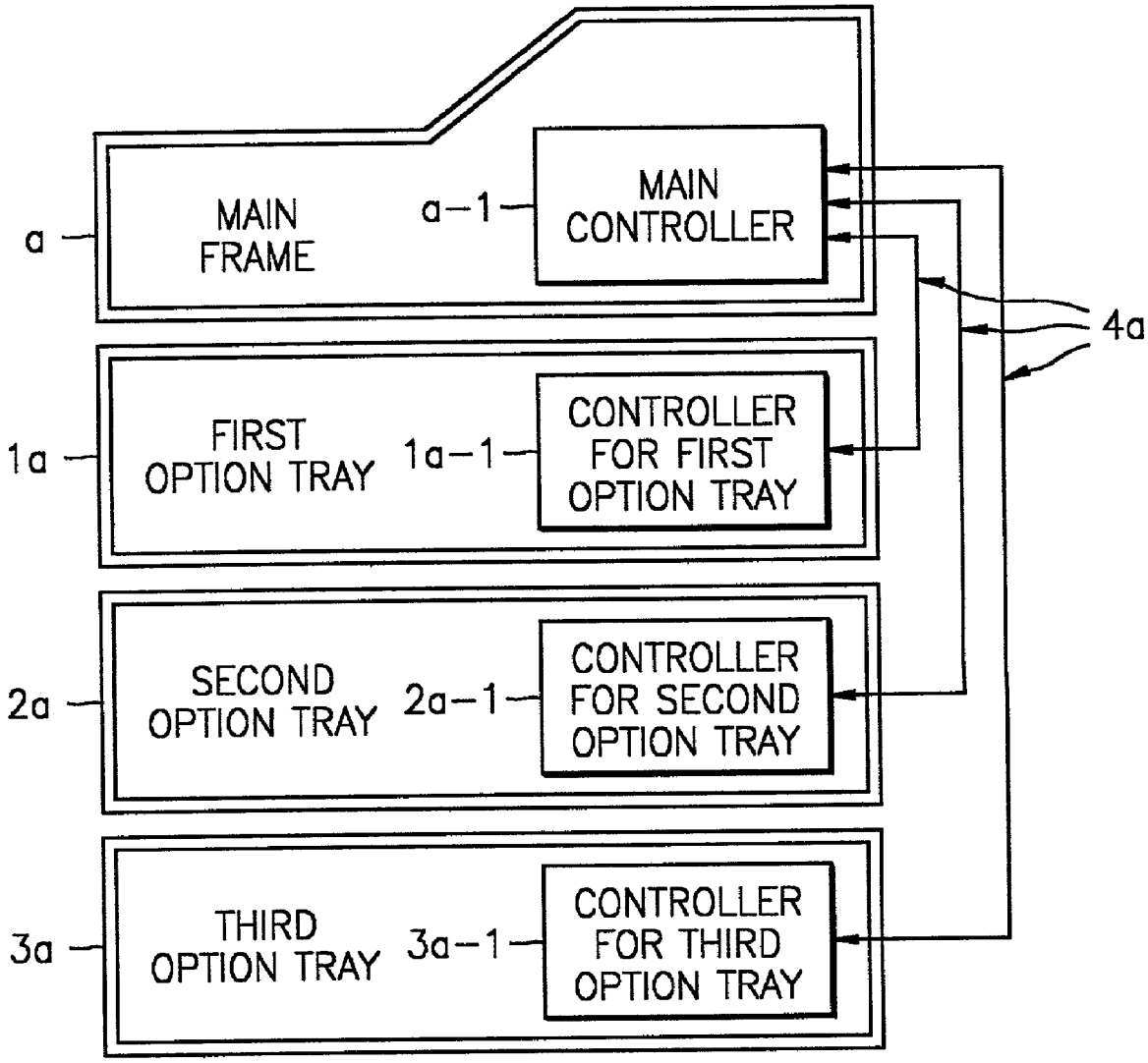
FIG. 1A (PRIOR ART)
FIGS. 1A and 1B are block diagrams of a conventional apparatus for recognizing trays.
Figure 1B:
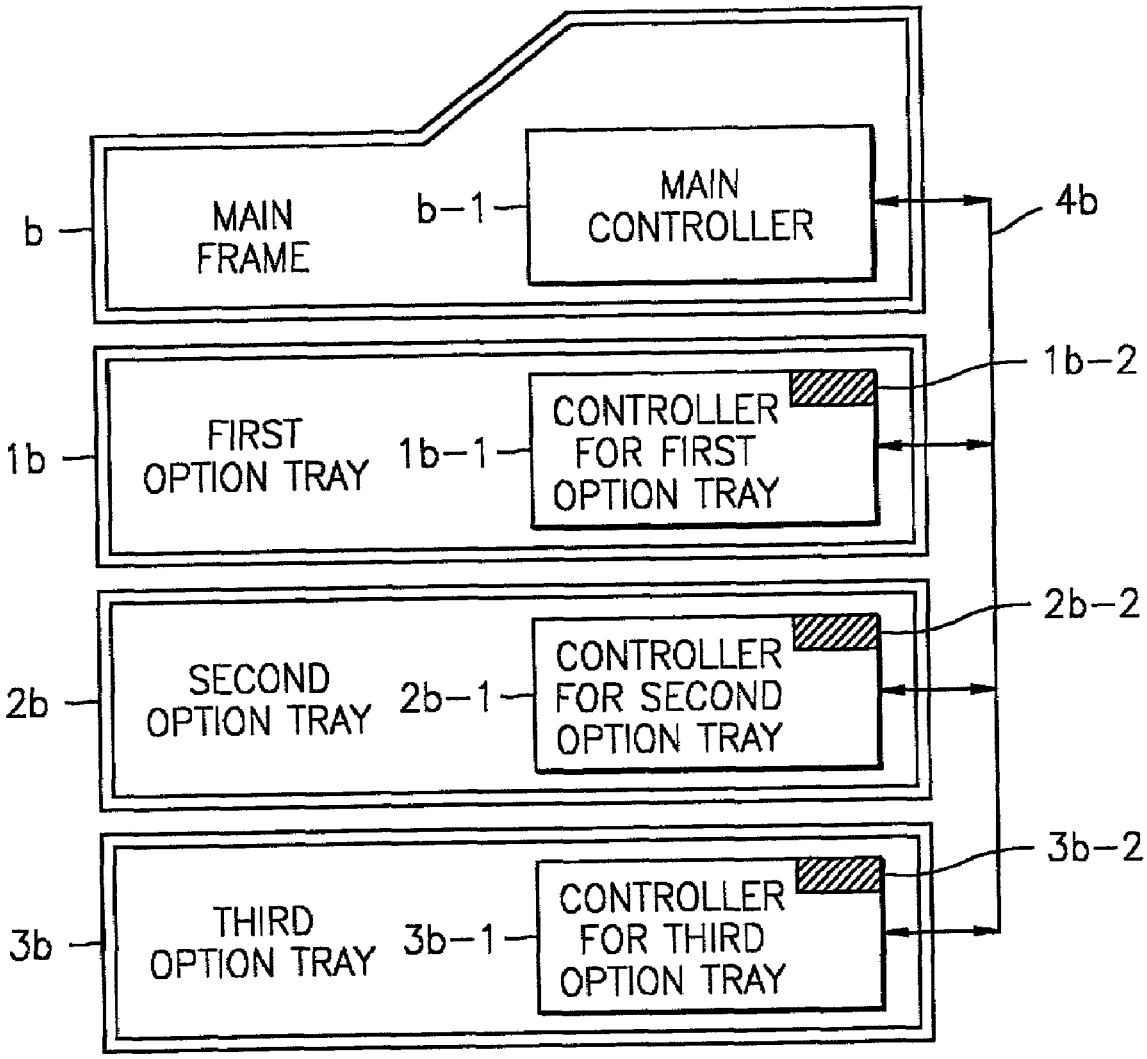
FIG. 1B (PRIOR ART)

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
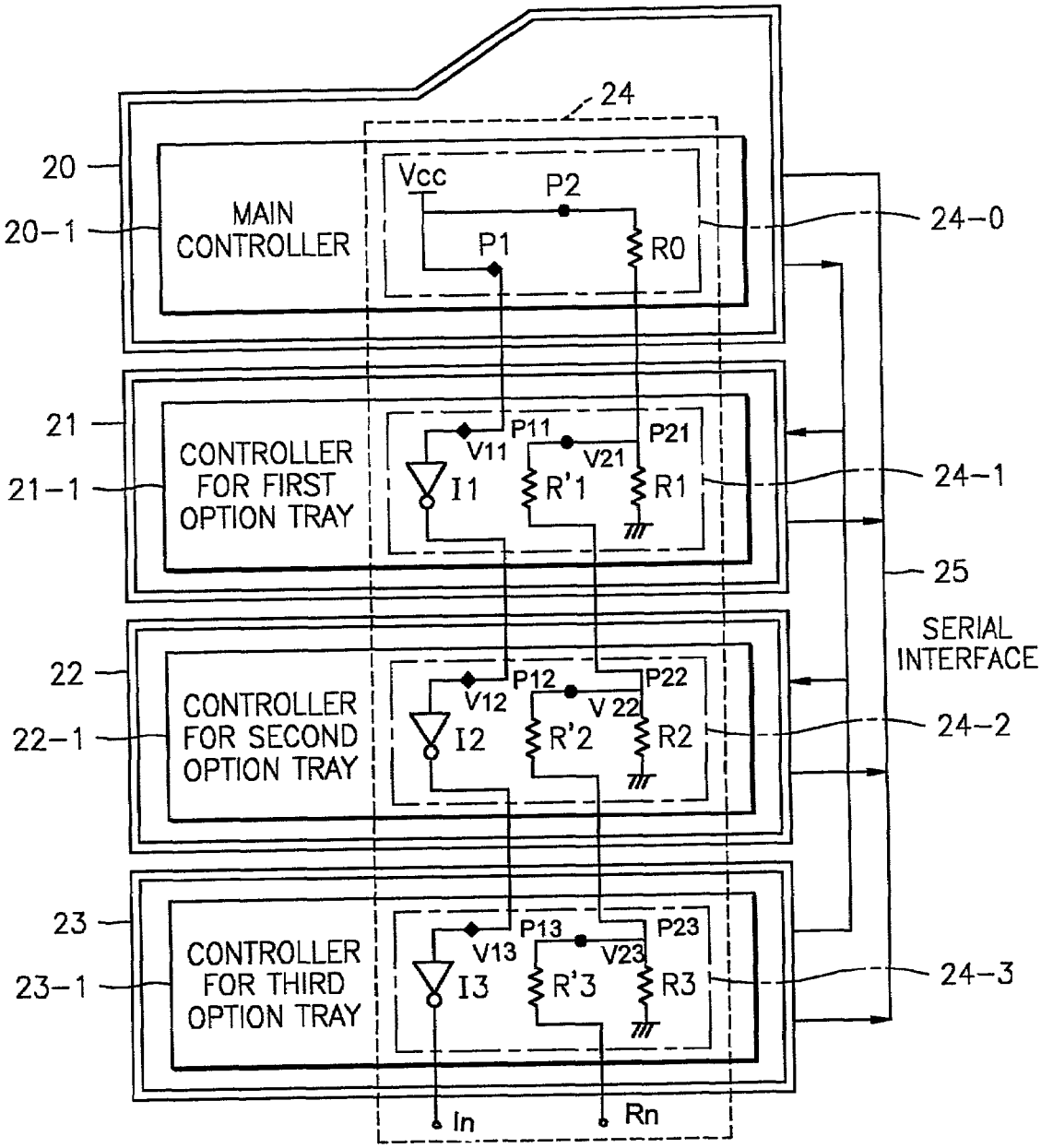
FIG. 2 is a block diagram of an apparatus for recognizing trays according to an embodiment of the present invention.

Referring to FIG. 2, which is a block diagram of an apparatus for recognizing trays according to an embodiment of the present invention, the apparatus for recognizing trays includes a main frame 20, a first option tray 21, a second option tray 22, a third option tray 23, an identification (ID) recognition circuit 24, and a serial interface 25.

The main frame 20 includes a main controller 20-1 and a power supply portion 24-0 supplying power to the ID recognition circuit 24. The first option tray 21 includes a first controller 21-1 and a first ID recognition section 24-1 recognizing a first ID of the first option tray 21 through the power supplied by the power supply portion 24-0. The second option tray 22 includes a second controller 22-1 and a second ID recognition section 24-2 recognizing a second ID of the second option tray 22 through the power output from the first ID recognition section 24-1. The third option tray 23 includes a third controller 23-1 and a third ID recognition section 24-3 recognizing a third ID of the third option tray 23 through the power output from the second ID recognition section 24-2.

The main controller 20-1 controls transmission and reception of printing data, data processing, motors, sensors, communications with the first, second, and third option trays 21, 22, and 23, and printing in a printer. Although three option trays are included in this embodiment of the present invention, three or more option trays may be included.

The first controller 21-1, the second controller 22-1, and the third controller 23-1 perform control operations of controlling motors and sensors required by the main controller 20-1, set their own IDs by reading logic from the ID recognition circuit 24 and transmit the set IDs to the main controller 20-1 through the serial interface 25.

The ID recognition circuit 24 is included in the main controller 20-1 and the first controller 21-1, the second controller 22-1, and the third controller 23-1, modifies a power value supplied by the main controller 20-1 and outputs each state of the first, second, and third option trays 21, 22, and 23 in response to the modified power value. Since the main controller 20-1 does not initially know how many option trays are included in the apparatus, the main controller 20-1 checks each of the option trays and determines that an option tray is not installed in the apparatus during a power-on state of the printer if there is no response from any option tray.

Assuming that three option trays are installed in the apparatus, the power supply portion 24-0 supplies power to recognize the trays. The power supplied by the power supply portion (24-0) represents a recognition signal recognized by each option tray. The power supplied by the power supply portion (24-0) is transmitted through two lines P1 and P2 and is represented by binary numbers, High (H or 1) and Low (L or 0).

The first controller reads signals at terminals p11, p21 on the lines P1 and P2 supplied by the power supply portion 24-0 and sets a first unique ID '1' for the first option tray 21 if the value of the read signals is HH (11). The value HH (11) of the read signals is derived from power levels V11, V21 detected at the terminals P11, P21. After the first unique ID is set by the controller 21-1, the first ID recognition section 24-1 inverts a first signal on the line P1 with an inverter I1, divides a second signal on the line P2 with a resistor R'1 and a ground resistor R1, and outputs the inverted signal and the divided signal to the second ID recognition section (24-2).

The second controller 22-1 reads modified signals on the lines P1 and P2 supplied by the first ID recognition section 24-1 and sets a second unique ID '2' for the second option tray 22 if the value of the read modified signal is LH (01). The value LH (01) of the read modified signals is derived from power levels V12, V22 detected at the terminals P12, P22. After the second unique ID is set by the second controller 22-1, the second ID recognition section 24-2 inverts the inverted signal on the line P1 output from the first ID recognition section 24-1 with an inverter I2, divides the divided signal on the line P2 with a resistor R'2 and a ground resistor R2, and outputs the second time inverted signal and second time divided signal to the third ID recognition section 24-2.

The third controller 23-1 reads signals at terminals P13, P23 of the lines P1 and P2 supplied by the second ID recognition section 24-2 and sets a third unique ID '3' for the third option tray 23 if the value of the read modified signal is HL (10). The value HL (10) of the read modified signals is derived from power levels V13, V23 detected at the terminals P13, P23. After the third unique ID is set by the third controller 23-1, the third ID recognition section (24-3) inverts the second time inverted signal of the line P1 output from the second ID recognition section 24-2 with an inverter I3, divides the second time divided signal on the line P2 with a resistor R'3 and a ground resistor R3, and outputs the third time inverted signal and the third time divided signal to a next ID recognition section (not shown) having terminals In and Rn.

The main frame 20 requests each of the first, second, and third option trays 21, 22, and 23, which are connected to the main frame 20, to transmit their own IDs. When unique IDs of the first, second, and third option trays 21, 22, and 23 are set, communications with the main controller (20-1) are performed. The first controller 21-1, the second controller 22-1, and the controller 22-1 first receive commands from the main controller 20-1, perform the received commands, and transmit each result of performing the commands to the main controller 20-1.

The serial interface 25 transmits and receives control data required in the main controller 20-1, and the first controller 21-1, the second controller 22-1 and the third controller 23-1 communicate with the main controller 20-1 through the common serial interface 25.

Figure 3:
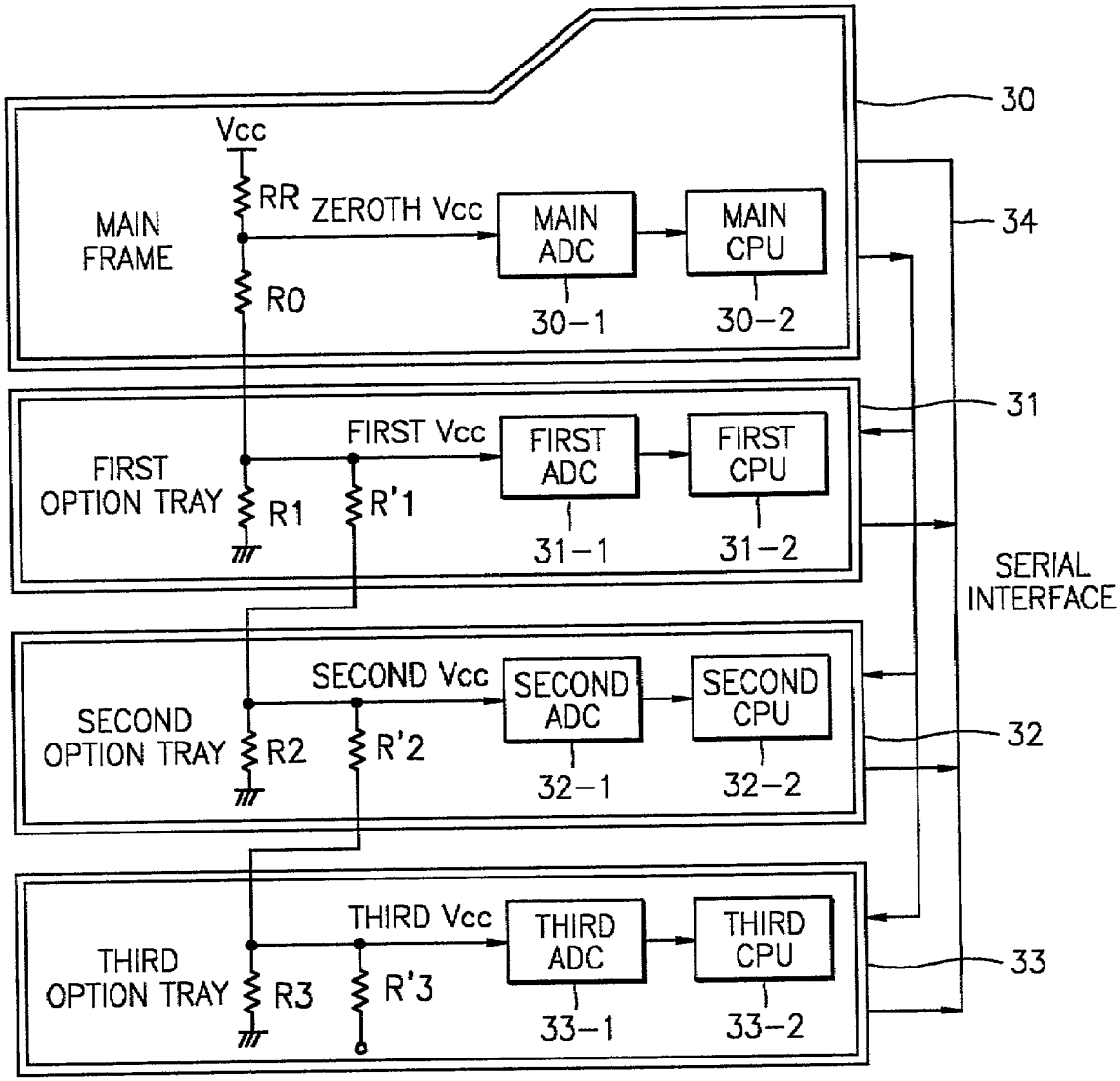
FIG. 3 is a block diagram of an apparatus for recognizing trays according to another embodiment of the present invention.

Referring FIG. 3, which is a block diagram of an apparatus for recognizing trays according to another embodiment of the present invention, the tray recognizing apparatus includes a main frame 30, a first option tray 31, a second option tray 32, a third option tray 33, and a serial interface 34.

The main frame 30 includes a main analog-to-digital converter (ADC) 30-1 converting a main voltage of a supply voltage (Vcc), which is lowered by a coupling resistor RR, into a main digital value, and a main central processing unit (CPU) 30-2 reading the main digital value of the main ADC 30-1, recognizing whether or not option trays are mounted in the apparatus and the number of mounted option trays, and communicating with the first, second, and third option trays 31, 32, and 33 through the serial interface 34.

The first option tray 31 includes a first dividing resistor R'1, a first ground resistor R1 dividing a voltage, which is output from the main frame 30 and lowered from the supply voltage Vcc by a main resistor R0 or resistors of the second option tray 32 and/or the third option tray 33, into a first voltage (first Vcc), a first ADC 31-1 converting the first voltage (first (Vcc) into a first digital signal, and a first CPU 31-2 reading the first digital value of the first ADC 31-1, setting a first unique ID for the first option tray 31, and communicating with the main CPU 30-2.

The second option tray 32 includes a second dividing resistor R'2 and a second ground resistor R2 dividing a voltage, which is output from the first tray 31 and lowered from the first voltage Vcc by the first dividing resistor R'1 and/or resistors of the third option tray 33, into a second voltage (second Vcc), a second ADC 32-1 converting the second voltage (second Vcc) into a second digital signal, and a second CPU 32-2 reading a second digital value of the second ADC 32-1, setting a second unique ID for the second option tray 32, and communicating with the main CPU 30-2.

The third option tray 33 includes a third dividing resistor R'3 and a third ground resistor R3 dividing a voltage, which is output from the second option tray 32 and lowered from the second voltage (second Vcc) by the second dividing resistor R'2 and/or the third dividing resistor when a fourth tray is connected to the third option tray 33, a third ADC 33-1 converting the third voltage into a third digital value, and a third CPU 33-2 for reading a third digital value of the third ADC 33-1, setting a third unique ID for the third option tray 33, and communicating with the main CPU 30-2.

| | Zeroth VCC | Hex | First VCC | Hex | Second VCC | Hex | Third VCC | Hex |
|---|---|---|---|---|---|---|---|---|
| No tray | X0 | A0 | — | — | — | — | | — |
| One tray | X1 | A1 | X1 | A1 | — | — | | — |
| Two trays | X2 | A2 | X2 | A2 | Y1 | B1 | | — |
| Three trays | X3 | A3 | X3 | A3 | Y2 | B2 | Z1 | C1 |

In Table 1, which is a reference table for recognizing unique IDs of option trays, a "zeroth" Vcc denotes an analog (main) signal of the supply voltage Vcc of the main frame 30 and is input into the main ADC 30-1, and Hex denotes the main digital value of the main ADC 30-1 read from the main CPU 30-2 in a hexadecimal format. The first VCC denotes an analog signal in which the "zeroth" Vcc is divided by the ground resistor R1 and the main resistor R0 and input into the first ADC 31-1, and Hex denotes the first digital value of the first ADC (31-1) and is read from the first CPU 31-2 in the hexadecimal format. The second Vcc denotes an analog signal in which the first VCC is divided by the ground resistor R2 and the first dividing resistor R'1 and input into the second ADC 32-1, and Hex denotes the second digital value of the second ADC and is read from the second CPU 32-2 in the hexadecimal format. The third Vcc denotes an analog signal in which the second Vcc is divided by the ground resistor R3 and the second dividing resistor R'2 and input into the third ADC 33-1, and Hex denotes the third digital value of the third ADC 33-1 read from the third CPU 33-2 in the hexadecimal format.

The main CPU 30-2 reads the zeroth Vcc, which is converted into the main digital value, and recognizes whether or not option trays are mounted in the apparatus and the number of mounted option trays. The main CPU 30-2 recognizes which tray is coupled to the main frame 30 and how many option trays are coupled to the main frame 30 in response to the zeroth Vcc (X1, X2, X3).

Referring to Table 1, the main CPU (30-2) determines that no option trays are mounted in the apparatus in a case where the zeroth Vcc is X0 (digital value A0), determines that the first option tray 31 is coupled to the main frame 30 in the apparatus in a case where the zeroth Vcc is X1 (digital value A1), determines that the second option tray 32 is coupled to the main frame 30 in the apparatus in a case where the zeroth Vcc is X2 (digital value A2), and determines that the third option tray 32 is coupled to the main frame 30 in the apparatus in a case where the zeroth Vcc is X3 (digital value A3).

The mounted option trays recognize their own IDs with reference to the output values of the ADCs and Table 1. For example, assuming that the first CPU (31-2) reads one of the first digital values A1, A2, and A3 (analog values X1, X2, and X3 of the first Vcc) output from the first ADC 31-1, a first unique ID (e.g., '1') is set in the first option tray 31.

The first Vcc input to the first ADC 31-1 of the first option tray 31 is X1 in a case where one option tray is connected to the first Vcc. The first Vcc input to the first ADC 31-1 of the first option tray 31 is X2 to which the level of the first VCC is changed in a case where two option trays are connected to the first Vcc. The first Vcc input into the first ADC 31-1 of the first option tray 31 is X3 to which the level of the first Vcc is changed in a case where three option trays are connected to the first Vcc.

Subsequently, assuming that the second CPU (32-2) reads one of the digital values B1 and B2 (analog values Y1 and Y2 of the second Vcc) output from the second ADC 32-1, a second unique ID (e.g., '2') is set in the second option tray 32.

The second Vcc input to the second ADC of the second option tray 32 has no meaning in a case where only the first option tray 31 is connected to the main frame 30. The second Vcc input into the second ADC of the second option tray 32 is Y1 to which the level of the second Vcc is changed in a case where two option trays are connected to the main frame 30. The second Vcc input into the second ADC of the second option tray 32 is Y2 to which the level of the second Vcc is changed in a case where three option trays are connected to the main frame 30. Subsequently, assuming that the third CPU 33-2 reads a digital value C1 (analog value Z1 of the third Vcc) output from the third ADC 33-1, a third unique ID (e.g., '3') is set in the third option tray 33.

The third Vcc input to the third option tray 33 has no meaning in a case where only one or two option trays are connected to the main frame 30. The third Vcc input into the third option tray 33 is Z1 in a case where three option trays are connected to the main frame 30.

The main frame 30 requests each of the first, second, and third option trays 31, 32, and 33, which are connected to the main frame 30, to transmit their own IDs. When unique IDs of the first, second, and third option trays 31, 32, and 33 are set in accordance with the first, second, and third digital values A1, A2, A3, the first, second, and third option trays 31, 32, and 33 perform communications with the main CPU (30-2). The first, second, and third CPUs (31-2), (32-2), and (33-2) receive commands from the main CPU (30-2), perform the received commands, and transmit the results of performing the commands to the main CPU (30-2).

One of the second and third option trays 32 and 33 is directly coupled to the main frame 30. The zeroth Vcc may be changed from X0 to X2 or a predetermined voltage due to the second ground resistor R2 coupled to the main resistor R0 of the main frame 30 when the second option tray 32 is directly coupled to the main frame 30. The zeroth Vcc may be changed from X0 to X3 or another predetermined voltage due to the third ground resistor R3 coupled to the main resistor R0 of the main frame 30 when the third option tray 32 is directly coupled to the main frame 30. In response to the change of the zeroth Vcc, the main CPU may recognize which tray is directly coupled to the main frame 30.

The power line coupled with the main resistor R0 and the coupling resistor RR may be extended to the second option tray 32 through the first option tray 31 in order for the second option tray 32 to communicate with the main frame 30 when the first option tray 31 is not coupled between the second option tray 32 and the main frame 30. The power line may be also extended to the third option tray 33 through the first option tray 31 and the second option tray 32 in order for the third option tray 33 to communicate with the main frame 30 when one or both the first option tray 31 and the second option tray 32 is not coupled between the third option tray 33 and the main frame 30.

The serial interface 34 transmits and receives control data required in the main CPU 30-2, and the first, second, and third CPUs (31-2), (32-2), and (33-2) communicate with the main CPU 30-2 through the common serial interface 34.

As described above, according to the present invention, unique IDs of trays, which are mounted as options, can be recognized without any manual operation by a user, thereby giving convenience to the user and preventing errors from occurring during an operation of the printer.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of recognizing trays in a printer having a main frame, the method comprising:

transmitting a recognition signal to a plurality of trays from the main frame;

controlling the trays to read the recognition signal and recognize unique codes which correspond to the trays in response to the recognition signal; and recognizing the unique codes of the trays, which are received by the main frame from the trays;

wherein the trays comprise a first tray and a second tray, and the modifying of the recognition signal comprises:

transmitting the recognition signal recognized by the first tray to the second tray; and modifying the recognition signal when the recognition signal is transmitted to the second tray from the first tray;

wherein the recognition signal comprises a first recognition signal and a second recognition signal transmitted through two lines, and the method comprises:

modifying the first recognition signal by inverting the first recognition signal when the first recognition signal recognized by the first tray is transmitted to the second tray; and dividing the second recognition signal when the second recognition signal recognized by the first tray is transmitted to the second tray, one of the two lines being grounded while the other line extended from the first tray is connected to the second tray.

2. The method of claim 1, wherein the recognition signal is a binary signal according to a predetermined voltage level of the recognition signal.

3. The method of claim 1, further comprising: requesting each tray connected to the main frame to transmit each unique code of the tray.

4. An apparatus for recognizing trays in a printer having a main frame, comprising:

a signal transmission unit transmitting a recognition signal to the trays from the main frame; and a recognition unit reading the recognition signal from the trays, recognizing unique codes which correspond to the trays, and transmitting the unique codes of the trays to the main frame;

wherein the trays comprise a first tray and a second tray, and the recognition unit modifies the recognition signal recognized by the first tray, which is received from the main frame, and transmits the modified recognition signal to the second tray;

wherein the recognition signal comprises a first recognition signal and a second recognition signal transmitted through two lines, and the recognition unit inverts the first recognition signal when the first recognition signal recognized by the first tray is transmitted to the second tray and divides the second recognition signal when the second recognition signal recognized by the first tray is transmitted to the second tray, and one of the two lines being grounded while the other line is connected to the second tray.

5. The apparatus of claim 4, wherein the recognition signal transmitted by the signal transmission unit is a binary signal according to a predetermined voltage level of the recognition signal.

6. An apparatus for recognizing a tray in a printer, comprising:

a main frame having a voltage source:

a first option tray coupled to the main frame, having a first voltage potential coupled to a ground, generating a first voltage signal when the first voltage potential is coupled between the voltage source of the main frame and the ground, and having a first controller recognizing a first identification signal for the first option tray in response to the first voltage signal; and a main controller receiving the first identification signal from the first option tray to recognize the first option tray coupled to the main frame, wherein the first option tray comprises a first dividing resistor coupled between the voltage source and the first voltage potential, and a second option tray having a second voltage potential coupled to a second ground, generating a second voltage signal when the second voltage potential is coupled between the first voltage potential and the second ground, having a second controller recognizing a second identification signal in response to the second voltage signal, the main controller receiving the second identification signal from the second option tray to recognize the second option tray coupled to the main frame.

7. The apparatus of claim 6, wherein the second voltage signal of the second option tray is different from the first voltage signal of the first option tray, and the first identification signal of the first option tray is different from the second identification signal for the second option tray.

8. The apparatus of claim 6, wherein the first option tray comprises a first analog to digital converter converting the first voltage signal to a first digital signal, the first controller generating the first identification signal in accordance with the first digital signal, and the second option tray comprises a second analog to digital converter converting the second voltage signal to a second digital signal, the second controller generating the second identification signal in accordance with the second digital signal different from the first digital signal.

9. The apparatus of claim 8, wherein the first analog to digital converter, the first controller, and a first ground resistor are integrally formed in the first option tray.

10. The apparatus of claim 6, further comprising a serial interface coupled between the main controller and the first and second controllers, wherein the main controller receives the first and second identification signals from the first and second controllers through the serial interface.

11. The apparatus of claim 10, wherein the main controller generates a command signal to the first and second controllers through the serial interface to request the first and second identification signals, and the first and second controllers transmit the first and second identification signals to the main controller through the serial interface, respectively, in response to the command signal.

12. The apparatus of claim 6, further comprising a serial interface coupled between the main controller and the first controller, wherein the main controller receives the first identification signal from the first controller through the serial interface.

13. The apparatus of claim 12, wherein the main controller generates a command signal to the first controller through the serial interface to request the first identification signal, and the first controller transmits the first identification signal to the main controller through the serial interface in response to the command signal and the first voltage signal.

14. An apparatus for recognizing a tray in a printer, comprising:

a main frame having a voltage source;

a first option tray coupled to the main frame, having a first voltage potential coupled to a ground, generating a first voltage signal when the first voltage potential is coupled between the voltage source of the main frame and the ground, and having a first controller recognizing a first identification signal for the first option tray in response to the first voltage signal; and a main controller receiving the first identification signal from the first option tray to recognize the first option tray coupled to the main frame wherein the main frame comprises a main converter a main voltage source to convert the main voltage source to generate a main digital signal, and the first option tray comprises a converter coupled to the first voltage source to convert the first voltage source to a first digital signal, the first controller generating the first identification in response to the first digital signal.

15. The apparatus of claim 14, wherein the main digital signal is different from the first digital signal.

16. The apparatus of claim 14, wherein the first option tray comprises a first dividing resistor coupled between the main voltage source and the first ground resistor, and the apparatus comprises:

a second option tray having a second ground resistor, generating a second voltage signal when the second ground resistor is coupled between the first dividing resistor and a ground, having a second converter converting the second voltage signal to a second digital signal and a second controller recognizing a second identification signal in response to the second digital signal transmitted from the second converter, the main controller receiving the second identification signal from the second option tray to recognize the second option tray.

17. The apparatus of claim 16, wherein the first voltage signal and the second voltage signal are different from each other.

18. The apparatus of claim 16, further comprising a serial interface coupled between the main controller and the first and second controllers, wherein the main controller receives the first and second identification signals from the first and second controllers through the serial interface.

19. The apparatus of claim 18, wherein the main controller generates a command signal to the first and second controllers through the serial interface to request the first and second identification signals, and the first and second controllers transmit the first and second identification signals to the main controller through the serial interface, respectively, in response to the command signal.

* * * * *

UNITED STATES PATENT AND TRADEMARK OFFICE

CERTIFICATE OF CORRECTION

PATENT NO. : 7,397,576 B2
APPLICATION NO. : 10/178955
DATED : July 8, 2008
INVENTOR(S) : Choon-ho Hong et al.

It is certified that error appears in the above-identified patent and that said Letters Patent is hereby corrected as shown below:

Column 9, Line 31, after “frame” insert --,--.

Signed and Sealed this

Twenty-eighth Day of October, 2008

JON W. DUDAS
*Director of the United States Patent and Trademark Office*